US006482060B1

(12) United States Patent
Gorny et al.

(10) Patent No.: US 6,482,060 B1
(45) Date of Patent: Nov. 19, 2002

(54) INFANT SELF-RIGHTING FLOTATION SEAT/CARRIER

(76) Inventors: Amy B. Gorny, 222 Superior Ave., Erie, PA (US) 16505; Peter J. Gorny, 222 Superior Ave., Erie, PA (US) 16505

( * ) Notice: Subject to any disclaimer, the term of this patent is extended or adjusted under 35 U.S.C. 154(b) by 93 days.

(21) Appl. No.: 09/665,265

(22) Filed: Sep. 19, 2000

Related U.S. Application Data

(63) Continuation-in-part of application No. 09/304,801, filed on May 4, 1999, now abandoned.
(60) Provisional application No. 60/084,372, filed on May 5, 1998.

(51) Int. Cl.[7] ..... B60H 2/26
(52) U.S. Cl. ..... 441/130; 297/183.6; 297/250.1
(58) Field of Search ..... 441/125, 126, 441/128, 129, 130, 131, 132; 114/360; 297/250.1, 183.6

(56) References Cited

U.S. PATENT DOCUMENTS

| | | | | |
|---|---|---|---|---|
| 3,620,570 A | | 11/1971 | Wilson | 297/448 |
| 4,516,806 A | | 5/1985 | McDonald et al. | 297/457 |
| 4,564,240 A | * | 1/1986 | Thieme | 297/183.6 |
| 4,601,667 A | | 7/1986 | Hull | 441/131 |
| 4,725,253 A | | 2/1988 | Politte | 441/130 |
| 4,798,551 A | | 1/1989 | Dumonceaux et al. | 441/130 |
| 4,799,910 A | | 1/1989 | Kellough | 441/131 |
| 5,279,237 A | | 1/1994 | Alivizatos | 112/262 |
| 5,409,411 A | | 4/1995 | Schrieber | 441/80 |
| 5,514,020 A | | 5/1996 | Gainforth | 441/126 |
| 5,516,190 A | * | 5/1996 | Kain et al. | 297/183.3 |
| 5,733,003 A | | 3/1998 | Goor | 297/250 |
| 5,993,276 A | * | 11/1999 | Ponton et al. | 441/130 |
| 6,036,563 A | | 3/2000 | Walker | 441/130 |
| 6,059,360 A | | 5/2000 | Bedard | 297/250 |

FOREIGN PATENT DOCUMENTS

| | | |
|---|---|---|
| FR | 1390534 | 1/1965 |
| FR | 2532907 | 9/1982 |

* cited by examiner

*Primary Examiner*—Sherman D. Basinger
(74) *Attorney, Agent, or Firm*—Wayne L. Lovercheck

(57) ABSTRACT

An infant seat/carrier equipped with low-density material spaced from the center of gravity of the seat/carrier to provide a torsion force on the seat/carrier to urge the seat/carrier to an upright position.

21 Claims, 3 Drawing Sheets

INFANT SELF-RIGHTING FLOTATION SEAT/CARRIER

CROSS REFERENCE TO RELATED APPLICATION

This application is a continuation-in-part of Ser. No. 09/304,801 filed May 4, 1999, now abandoned. This application also claims the benefit of U.S, Provisional Application Serial No. 60/084,372 filed May 5, 1998.

BACKGROUND OF THE INVENTION

1. Field of the Invention

This invention relates generally to a child carrier and more particularly to a floatable child seat/carrier with low density material spaced from the center of gravity of the seat/carrier to provide a torsion force on the seat/carrier when the seat/carrier is immersed in water to urge the seat/carrier to an upright position.

2. Description of the Prior Art

Common problems of the known devices of the conventional types are the need for a ballasting material contained within or attached to the structure or components of the child carrier. This can render the carrier subject to misuse as the weight can be excessive and may lead to the heavy ballast components being detached or emptied which can hinder or completely disable the carrier's ability to float or upright itself and the child contained within.

Various carrier devices have been constructed for protecting a child from total immersion in a body of water; however none of the known prior art devices offer all of the new and unique features of the present invention in combination.

Applicant is aware of the following U.S. Pat. Nos.: 3,620,570; 4,516,806; 4,725,253; 4,798,551; 4,799,910; 5,279,237; 5,409,411; 5,514,020; 5,733,003; 6,036,563; and, 6,059,360. Applicant is also aware of French Patent Nos. 1,390,534 and 2,532,907.

SUMMARY OF THE INVENTION

Many combinations of child carriers have been constructed to provide for a carrier that provides protection to the child from total immersion and or drowning. Most require a form of ballast that serves to upright and stabilize the carrier once it has entered a body of water. These ballasts are typically of a high-density material such as sand, gravel, metal or water which are contained in, or attached to the structure of the carrier. Some ballasts weigh upwards of 30 pounds which can make the carrier too heavy to readily move about from place to place. The possibility exists that the ballast container may be emptied or various weights attached to handles or other parts of a carrier may be detached or moved to an improper position by user's of the carriers because the heavy ballast components are in the way of easy portability and use. This can lead to a non-functional self-righting carrier at the very time it is needed most.

The present invention is brought forth as a combination of features that are light weight, permanently attached and utilize water as a ballast for self righting but do not require the heavy ballast water to be contained in the carrier except when the carrier should fall into a body of water. At the time of immersion a chamber will fill with water and provide a self-righting rotational force in addition to that gained from a unique arrangement of flotation materials.

It is an object of the present invention to provide an improved infant flotation seat/carrier.

Another object of the present invention is to provide an infant flotation seat/carrier that will quickly right itself to a normal upright position from any other position in the water without the use of ballast weight being built into the structure of the carrier.

Another object of the present invention is to provide an infant flotation seat/carrier that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
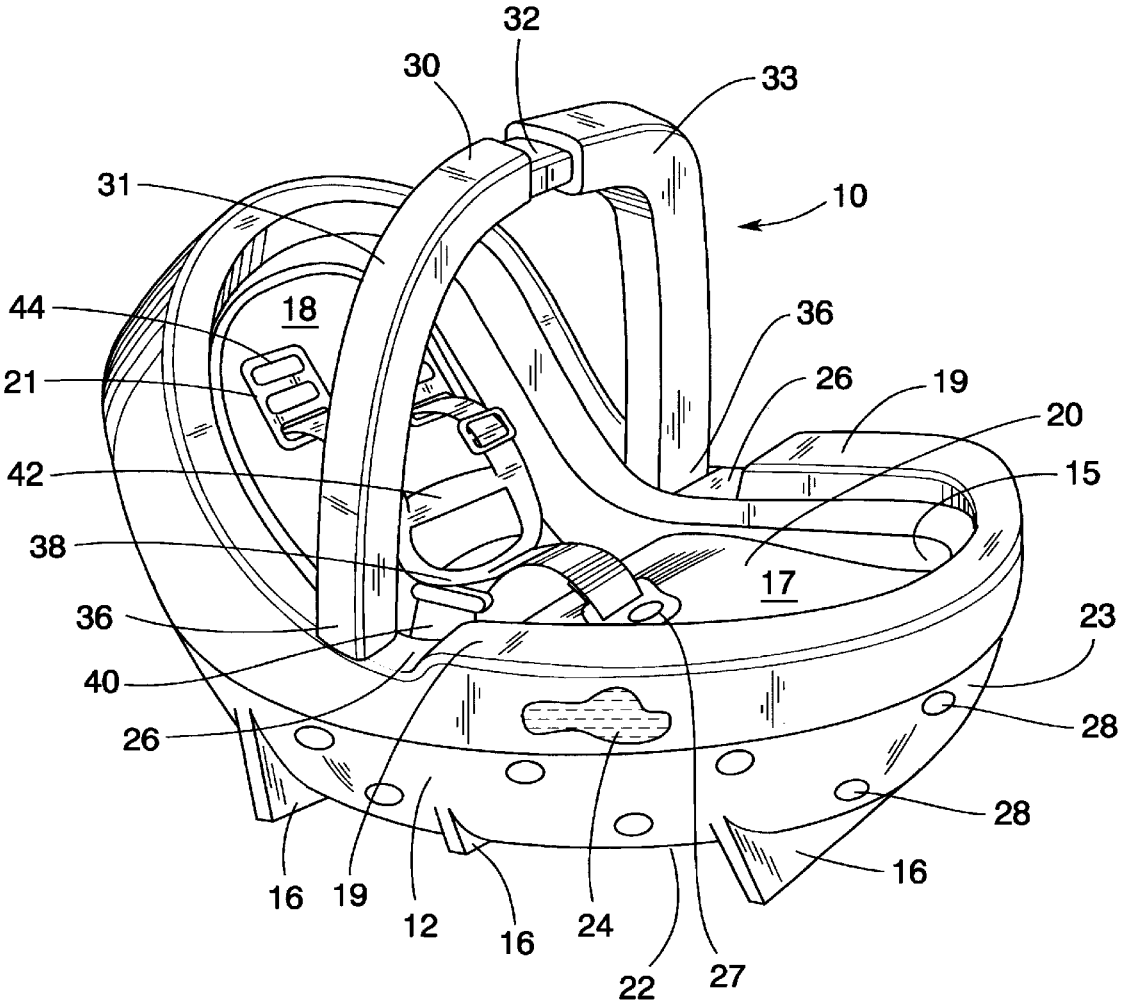
FIG. 1 is a perspective view of an infant flotation seat/carrier according to the invention.
Figure 2:
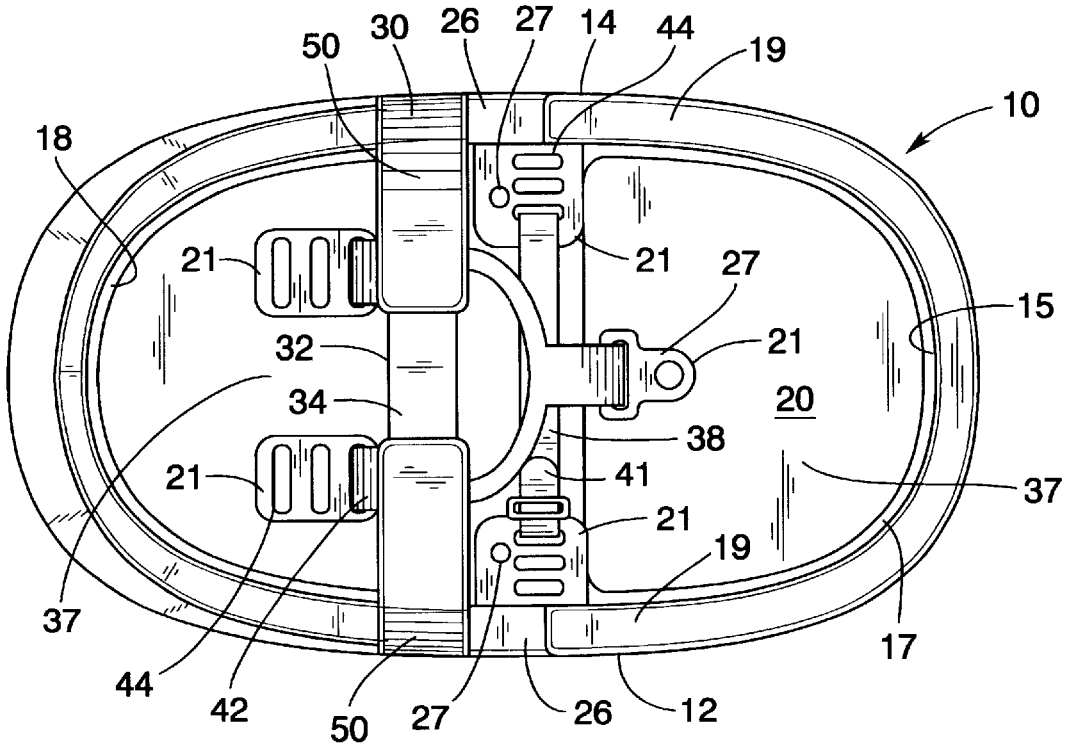
FIG. 2 is a top view of the seat/carrier according to the invention.
Figure 3:
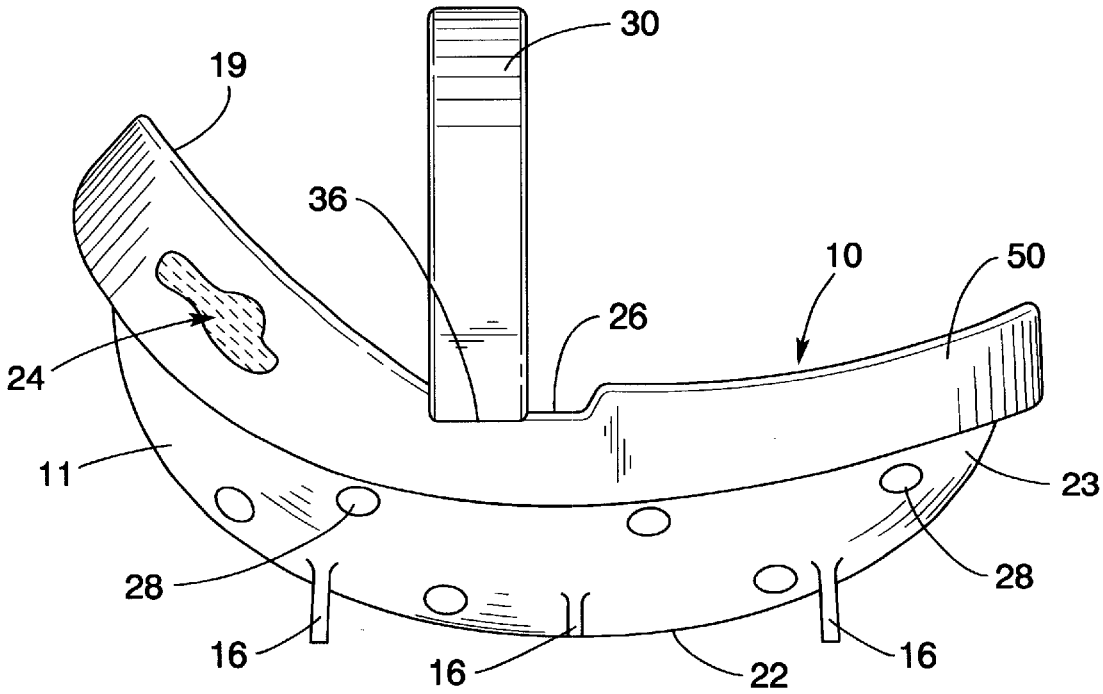
FIG. 3 is a side view of the seat/carrier according to the invention.
Figure 4:
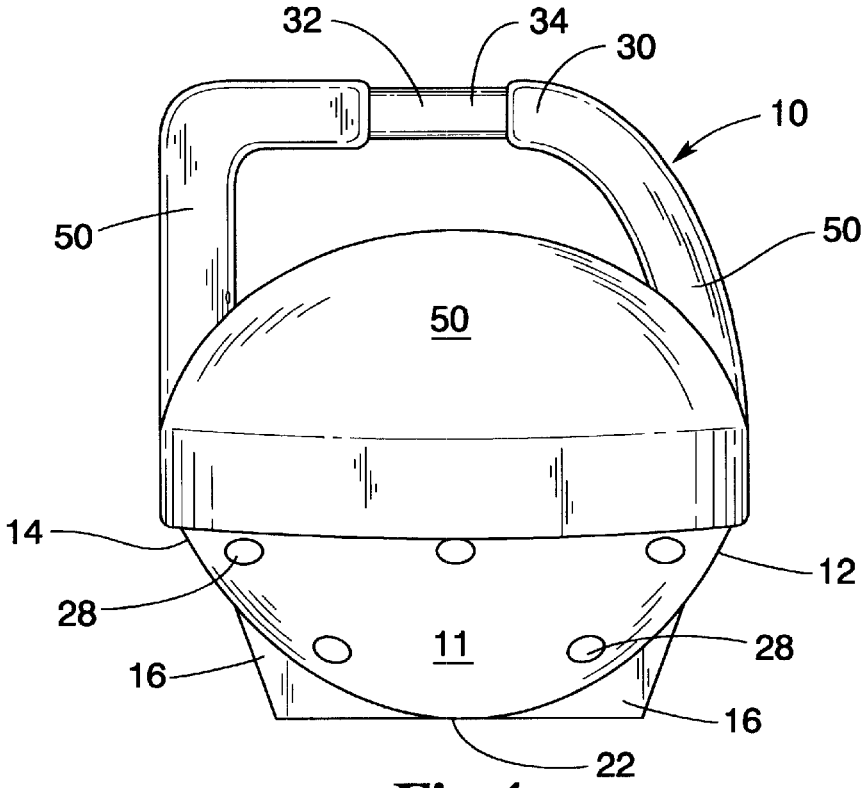
FIG. 4 is a rear view of the seat/carrier according to the invention.
Figure 5:
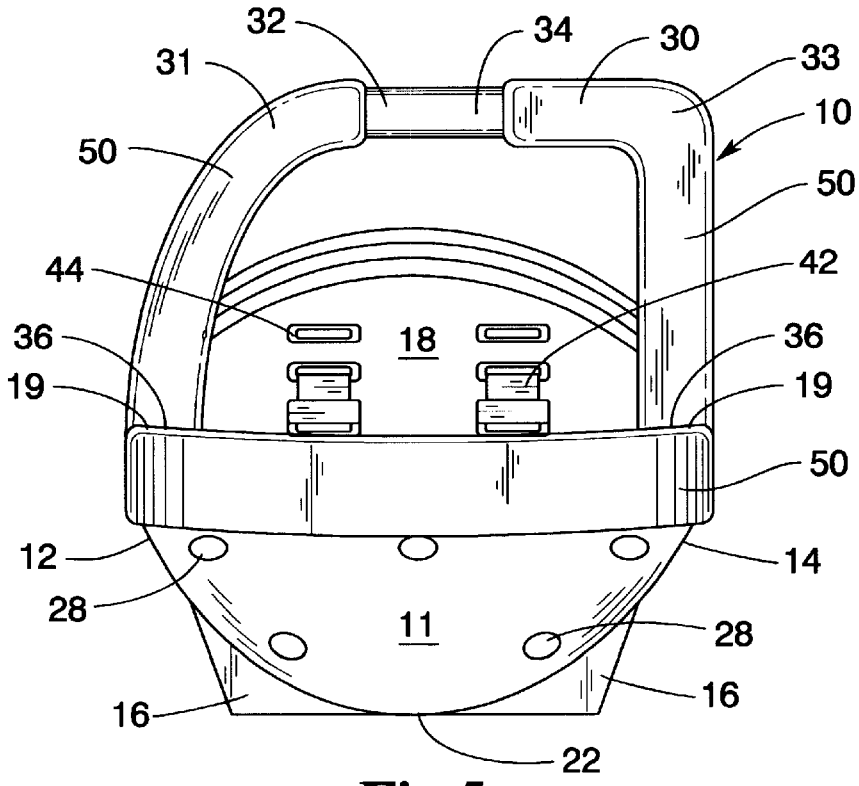
FIG. 5 is a front view of the seat/carrier according to the invention.

Now with more particular reference to the drawings, shown is infant flotation seat/carrier 10 that can be manufactured by injection, blow or roto molding of thermoplastic or other like material.

Infant flotation seat 10 is made up of a shell 11 having an interior 15, an exterior 23, an upper end 19, a bottom 22, two spaced side members 12, 14 that have attached a seat member 17 and a back member 18 and a shape of a truncated bird's egg. A baby pad 20 is attached to the seat member 17 and back member 18.The baby-pad 20 is made of a thin plastic or vinyl type material and filled with a soft latex or plastic foam. The baby pad has clearance cutouts 21 at various locations to provide clearance to the seat drain holes 27 and seat belt mounting slots 44 which are cut into the seat member 17 and back member 18. Shell 11 is formed into a shape resembling a bird's egg with a portion removed at the top.

Stabilizing feet members 16 underlie the bottom 22 and extend up the exterior 23 of shell 11 to support the seat on any chosen flat surface such as a car or boat seat or table or floor. Upper end 19 of side members 12, 14 and back member 18 extends outwardly and downwardly forming space 24 extending from the front of the seat and around the back of the seat. Upper end 19 is in the shape of a peripheral flange, which extends outwardly and downwardly around the entire upper edge of the seat along the upper edge of the side members and back member. The flange provides a convenient place to mount the low density flotation material 50 that extends from the upper end 19 of the shell 11 to approximately half way above the bottom 22 and completely around the periphery. A set of vehicle seat belt locks 26 are provided on the upper end 19 located just forward of the handle lower end 36 mounting point. These seat belt locks 26 can be used with the seat belts found in a car or other similar vehicle or a boat or other watercraft to restrain a child while the vehicle or vessel is in motion. A set of seat belts 38 comprising a waist belt 41 and a three point chest and crotch belt 42 are attached to the seat member 17 and back member 18 which restrain the child while it is in the infant flotation seat carrier. These seat belts 38 serve to protect the child by holding it firmly within the shell 11 while being transported by hand, vehicle or vessel or if the child and carrier should fall into a body of water.

Asymmetric shaped handle 30 extends upwardly from side members 12, 14 and crosses the seat at the midpoint thereof. The asymmetric handle 30 has an internal frame 34, which is formed with a curved portion 31 and a squared corner portion 33. The asymmetric handle 30, lower ends 36 are fixed to sides 12,14 at the upper end 19 of shell 11. A center handgrip 32 is formed by the internal frame 34 having a center portion not covered in the low-density flotation material 50 which otherwise is attached to the curved 31 and square corner 33 of the handle 30. The low-density flotation material 50 helps to turn the seat to a normal floating position from an inverted or other capsized position in the water. The square corner portion 33 of the handle 30 provides a slightly longer moment arm and greater flotation than that of curved portion 31 thereby increasing the rate and providing a consistent direction of rotation about the center of gravity for a quicker uprighting from an inverted or capsized position in the water.

When child carrier 10 is immersed in water in an inclined and upright position, the flotation material is so distributed on carrier 10 that it exerts a positive force on the chair in relation to the surface of the water. The force is spaced from the center of gravity of carrier 10 and the torsional force exerted on carrier 10 will be equal to the distance of the force from the center of gravity times the floatational force. This force will tend to force the carrier 10 to an upright position from an inverted or capsized position as well as remain in the upright position.

The flotation material is distributed on the child carrier so that the carrier will float in a normal position, but if carrier 10 is inclined from the normal position, flotation material 50 will exert forces on the carrier to bring it to a normal position. By having low density flotation material on the upper exterior of the shell 23 as well as on the handle 30, the flotation force increases as the carrier 10 rotates further away from the upright position. A series of ballast ports 28 are cut through the shell 11 so that the space 37 formed by the bottom of the seat member 17 and back member 18 and the interior of the shell 15 will fill with water if the child carrier should fall into a body of water. This ballast water will help to keep the child carrier 10 upright by lowering the center of gravity in relation to the surface of the water thereby stabilizing the carrier when waves or other forces tend to over turn the carrier. The ballast ports also help to upright the child carrier 10 if it should fall into the water in an inverted or capsized position. The space 37 will fill with water and exert a negative (in relation to the surface of the water) torsional force one hundred and eighty degrees opposite to the positive torsional force provided by the asymmetrical handle's 30 low density flotation material 50 thereby further increasing the rotation rate about the center of gravity.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A self-righting flotation seat/carrier comprising a shell having the shape of a truncated bird egg;

said shell having two spaced side members, a seat, backrest and handle attached to said side members of said shell;

said shell having ballast admitting ports extending therethrough;

flotation means fixed to said side members and said handle; and, said flotation means being adapted to apply a torsional force to said seat/carrier urging said seat/carrier to an upright position when said seat/carrier is immersed in water.

2. The flotation seat/carrier recited in claim 1 wherein said ballast admitting ports are dispersed across said shell so as to quickly fill the inside of said shell with water when said seat/carrier becomes immersed, thereby providing an additional torsional force by which the seat/carrier is made to be self righting and increasing stability once righted.

3. The flotation seat/carrier recited in claim 1 wherein said flotation means are comprised of a low density foamed plastic material having closed cells and being non absorbent.

4. The flotation seat/carrier recited in claim 1 wherein said side members extend up a substantial distance above said seat; and, said backrest extending between said side members and across the rear end of said seat and integrally attached to said side members and said seat at their rear end thereof.

5. The flotation seat/carrier recited in claim 4 wherein an additional flotation means is attached to the top side of said backrest in a thin layer and extends forward and is attached to the top of said seat and extends across to the front of said seat.

6. The flotation seat/carrier recited in claim 4 wherein each said side of said shell has a slot located forward of said handle therein for receiving a seatbelt for holding said seat in place in or on a vehicle, watercraft, vessel or transportation vehicle.

7. The flotation seat/carrier recited in claim 1 wherein said flotation means fills an upper portion of said shell and extends generally around said shell.

8. A flotation seat/carrier recited in claim 1 wherein said handle is asymmetrical, U-shaped and attached adajacent a midpoint of said sides of said shell above said seat;

said handle having one leg of the U-shape in the form of one half of a U cut at the center and bottom of the U; and, said handle having it's other leg being in the shape of an L, with the bottom of the L being attached to said one half U-shaped leg thereby forming an asymmetrical U-shape and having the inverted U-shape attached to said shell.

9. The flotation seat/carrier recited in claim 1 wherein stabilizing feet members are fixed to the bottom of said shell for engaging a supporting surface; and, said feet members being of a thin cross section and oriented perpendicular to the axis of self righting rotation.

10. The flotation seat/carrier recited in claim 1 wherein said seat and back have mounting slots to which are attached a set of seat belts;

said seat belts comprising a waist strap having an attachment point at each of two ends and a three point chest/crotch belt having an attachment point at each end of two shoulder straps and at one end which would pass through the crotch of a seated child; and, said seat belts having adjustment means for securing children of different sizes.

11. A self-righting flotation child seat/carrier comprising a seat and a backrest fixed together having an asymmetrical U-shaped handle having a center part and two ends attached to said seat and extending upward therefrom and having a center of gravity;

said seat and backrest having ballast admitting ports extending therethrough; and, flotation material attached to said seat/carrier at a position such that when said seat/carrier is immersed in water, said flotation material exerts a torsion force on said seat/carrier to urge said seat/carrier to an upright position.

12. The flotation seat/carrier recited in claim 11 further comprising a shell having the shape of a truncated bird's egg.

13. The flotation seat/carrier recited in claim 11 wherein said ballast admitting ports are dispersed across said seat and back so as to quickly fill the inside of said seat and back with water when said seat/carrier becomes immersed, thereby providing an additional torsional force by which the seat/carrier is self righting and stable once righted.

14. The flotation seat/carrier recited in claim 11 further comprising side members extending upwardly a substantial distance above said seat; and, a backrest extending between said side members and across the rear end of said seat and integrally attached to said side members and said seat at their rear end thereof.

15. The flotation seat/carrier recited in claim 14 wherein flotation means is attached to said side members and extends adjacent the top of said backrest downwards to about the midpoint between the top and bottom and along the outside of the perimeter of said shell.

16. A self-righting flotation seat/carrier comprising a shell having two spaced side members, a seat, backrest and handle attached to said side members of said shell;

ballast admitting ports extending through said shell and being dispersed across said shell so as to quickly fill the inside of the shell with water when said seat/carrier becomes immersed;

flotation means fixed to said side members and said handle; and, said flotation means being adapted to apply a torsional force to said seat/carrier urging said seat/carrier members to an upright position when said seat/carrier is immersed in water.

17. The flotation seat/carrier recited in claim 16 wherein said shell has the shape of a truncated bird's egg.

18. A flotation seat/carrier recited in claim 16 wherein an asymmetrical U-shaped handle is attached to the midpoint of said sides of said shell above said seat;

said handle having one leg of the U-shape in the form of one half of a U cut at the center and bottom of the U; and, said handle having it's other leg being in the shape of an L, with the bottom of the L being attached to said one half U-shaped leg thereby forming an asymmetrical U-shape and having the inverted U-shape attached to said shell.

19. The flotation seat/carrier recited in claim 16 wherein said side members extend up a substantial distance above said seat; and, said backrest extending between said side members and across the rear end of said seat and integrally attached to said side members and said seat at their rear end thereof.

20. The flotation seat/carrier recited in claim 16 wherein said flotation means fixed to said side members extends adjacent the top of said backrest downwards to about the midpoint between the top and bottom and along the outside of the perimeter of said shell.

21. A self-righting flotation seat/carrier comprising a shell having the shape of a truncated bird egg;

said shell having two spaced side members, a seat, backrest and handle attached to said side members of said shell;

flotation means fixed to said side members and said handle;

said flotation means being adapted to apply a torsional force to said seat/carrier urging said seat/carrier to an upright position when said seat/carrier is immersed in water;

said handle being asymmetrical, U-shaped and attached adjacent a midpoint of said sides of said shell above said seat;

said handle having one leg of the U-shape in the form of one half of a U cut at the center and bottom of the U; and, said handle having it's other leg being in the shape of an L, with the bottom of the L being attached to said one half U-shaped leg thereby forming an asymmetrical U-shape and having the inverted U-shape attached to said shell.

* * * * *